US005253731A

United States Patent [19]

Moog

[11] Patent Number: 5,253,731

[45] Date of Patent: Oct. 19, 1993

[54] BRIDGE UNDERVIEW DEVICE

[76] Inventor: Alfons Moog, Untersiggingen 110, 7774 Deggenhausertal 3, Fed. Rep. of Germany

[21] Appl. No.: 838,403

[22] PCT Filed: Sep. 7, 1990

[86] PCT No.: PCT/DE90/00685

§ 371 Date: Mar. 6, 1992

§ 102(e) Date: Mar. 6, 1992

[87] PCT Pub. No.: WO91/03603

PCT Pub. Date: Mar. 21, 1991

[30] Foreign Application Priority Data

Sep. 8, 1989 [DE] Fed. Rep. of Germany ..... 8910749

[51] Int. Cl.[5] ..... E04G 1/36

[52] U.S. Cl. ..... 182/63; 182/2

[58] Field of Search ..... 182/63, 2

[56] References Cited

U.S. PATENT DOCUMENTS 3,357,517 12/1967 Wagner .
3,608,669 9/1971 Lindsay, Jr. ..... 182/16 X
4,074,790 2/1978 Colbachini et al. ..... 182/2
4,154,318 5/1979 Malleone .
4,696,371 9/1987 Moog .

FOREIGN PATENT DOCUMENTS 0156304 10/1985 European Pat. Off. .
2370148 6/1978 France .

*Primary Examiner*—Alvin C. Chin-Shue
*Attorney, Agent, or Firm*—Spencer, Frank & Schneider

[57] ABSTRACT

A bridge underview device includes a chassis; a turntable mounted on the chassis and being rotatable about a vertical axis; a bearing element mounted on the turntable by a first pivot joint for a swinging motion about a horizontal axis of the first pivot joint; a guide member; an elevating tower mounted on the guide member for gliding displacement relative to the guide member; a first arm coupled to the bearing element by a second pivot joint and to the guide member by a third pivot joint; and a second arm extending parallel to the first arm and being coupled to the bearing element by a fourth pivot joint and to the guide member by a fifth pivot joint. The second, third, fourth and fifth pivot joints each have a horizontal axis, whereby the guide member and the elevating tower are swingable as a unit relative to the bearing member in a vertical plane while maintaining an unchanged orientation. There are further provided positioning devices for maintaining the bearing member in a desired angular position relative to the chassis and for maintaining the guide member in a desired distance relative to the bearing member.

5 Claims, 2 Drawing Sheets

BRIDGE UNDERVIEW DEVICE

BACKGROUND OF THE INVENTION

The invention relates to a raisable and lowerable elevating tower which extends downwards over the bridge edge and to which is fitted a work platform projecting beneath the bridge, and having a chassis located on the bridge and exhibiting a bearing element which is vertical in the working position and is connected to the elevating tower by means of arms protruding over the bridge edge.

A device of this kind is known, for example, from European Disclosure Specification 156 304. As a vertical bearing element, there is here provided a so-called guide tower of considerable height. On its side pointing, in the operating position, towards the bridge edge, it has guide rails, in which a slide is guided which can be moved up and down by means of a lifting cylinder. To the slide are fastened jibs projecting perpendicularly to the guide tower, i.e. horizontally, which are firmly connected to the elevating tower. The rigid structural unit comprising elevating tower, jibs and slide is thus guided on the guide tower. The vertical position of the jibs determines the vertical position of the work platform.

Often it is necessary to cross over high obstacles disposed on the bridge edge, e.g. protective fencing, soundproofing walls or lighting masts, with the jibs. Although this can be done by using a sufficiently high guide tower, the elevating tower can then no longer be moved in a vertical direction in order to bring the work platform to the correct distance from the underside of the bridge support.

A further problem presents itself in connection with so-called truss bridges, the girders of which located at both sides of the carriageway comprise mutually alternating vertical columns and oblique ties, which are connected to one another at the top by horizontal trusses. Here, one is forced to reach with the jibs through the windows formed from column, tie and truss, to be precise, over or under the oblique tie. Depending upon the pattern of the latticework, this necessitates, at various locations along the bridge, different heights for the work platform, which is unacceptable.

SUMMARY OF THE INVENTION

The object of the invention is to propose a self-erecting bridge underview device, which crosses over high obstacles on the bridge edge and oblique lattice ties whilst allowing the height of the work platform to be altered, and is easy to construct and simple to use.

This object is achieved according to the invention, in the case of a bridge underview device of the generic type, by the elevating tower being received by a guide member and being movable in relation to this in the longitudinal direction of the tower, and by the arms being attached, in a horizontally axial manner, at one end to the bearing element and at the other end to the guide member and forming a double parallelogram, and by the arms, in relation to a mid-position perpendicular to the elevating tower, being free to swivel out to both sides.

In place of a guide tower, a relatively low bearing element is provided in the form of an essentially rectangular frame, to which a total of at least four mutually parallel running arms are directly attached. On the elevating tower side, the arms are attached to a guide member, on which the elevating tower is guided in vertically movable manner. Preferably, the arms are of such a length that, between the downwardly and upwardly pivoted end positions of the guide member, a height difference of at least 1.5 m or so can be obtained.

The vertical position of the elevating tower and of the thereby supported work platform can therefore be altered by two mutually independent means; firstly by moving the elevating tower in relation to the guide member and secondly by pivoting the arms up and down. This twin vertical adjustment facility enables the device to be used in the case of truss bridges, for, when the arms have to be pivoted downwards, the elevating tower can move correspondingly upwards and vice versa.

Since the vertical-adjustment ranges are added together, the range of adjustment of the elevating tower can be relatively small in relation to the guide mechanism, so that, with considerable cost savings, a simple lifting cylinder can be used in place of a telescopic cylinder.

Preferably, the double parallelogram formed by the arms can be actuated by means of at least one lifting cylinder acting obliquely upon the arms or upon the guide member on the one hand and upon the bearing element on the other hand.

For installation, it is advantageous if the chassis exhibits a turntable which is pivotable about a vertical axis and if the bearing element is adjustably mounted on this such that it can be pivoted about a horizontal axis. By slightly altering the angular position of the bearing element, any transverse inclination of the carriageway can be offset, as can a lateral inclination of the chassis relative to the carriageway caused by a road shoulder or similar.

In order to be able, where required, to cross over particularly wide barriers at the bridge edge and, when the arms are pivoted up and down, to obtain yet greater height differences for the guide member, the arms can have a length-adjustable configuration.

The pivotability of the arms also has the advantage that the transport height, i.e. the height of the bridge underview device when loaded for road transport onto a vehicle, can be kept small. In this case, the bearing element is found in horizontal position and the elevating tower plus guide member parallel above it. By tilting the arms, the elevating tower can thus be lowered and the total height reduced.

The described device allows a particularly comfortable and secure climb from the chassis to the elevating tower, since the two lower arms are connected to each other by a base. The distance between this base and the upper arms, which are transversely brace-connected to one another, can amount to 2 m, for example, so that it is possible to walk upright on the traversing bridge. At the side, pliable railings can be fitted.

In individual cases, in order once again to gain extra height for crossing over soundproofing walls or similar, it is expedient if the lower arms on the bearing element and on the guide member an be displaced, according to choice, into higher placed articulated eyes. The gained height reduces however the standing height on the traversing bridge. This can be countered by an extension of the bearing element and by a V-shaped arrangement of the cross-ties between the upper arms. A V-arrangement of this kind reduces the risk of one's head knocking against it.

The described bridge underview device is extremely flexible in its use. It can even be erected when the space above the carriageway, e.g. in the case of motorway junction constructions, is restricted by a further intersecting carriageway. High obstacles at the edge of the carriageway can be crossed over, without the vertical mobility of the work platform being thereby impaired. On the other hand, the elevating tower, when the arms are angled downwards, reaches extremely low under the bridge, so that even very tall bridge supports can be inspected from below from the work platform.

BRIEF DESCRIPTION OF THE DRAWING

An illustrative, preferred embodiment of the invention is explained below with reference to the drawing. More specifically.

DESCRIPTION OF THE PREFERRED EMBODIMENTS

Figure 1:
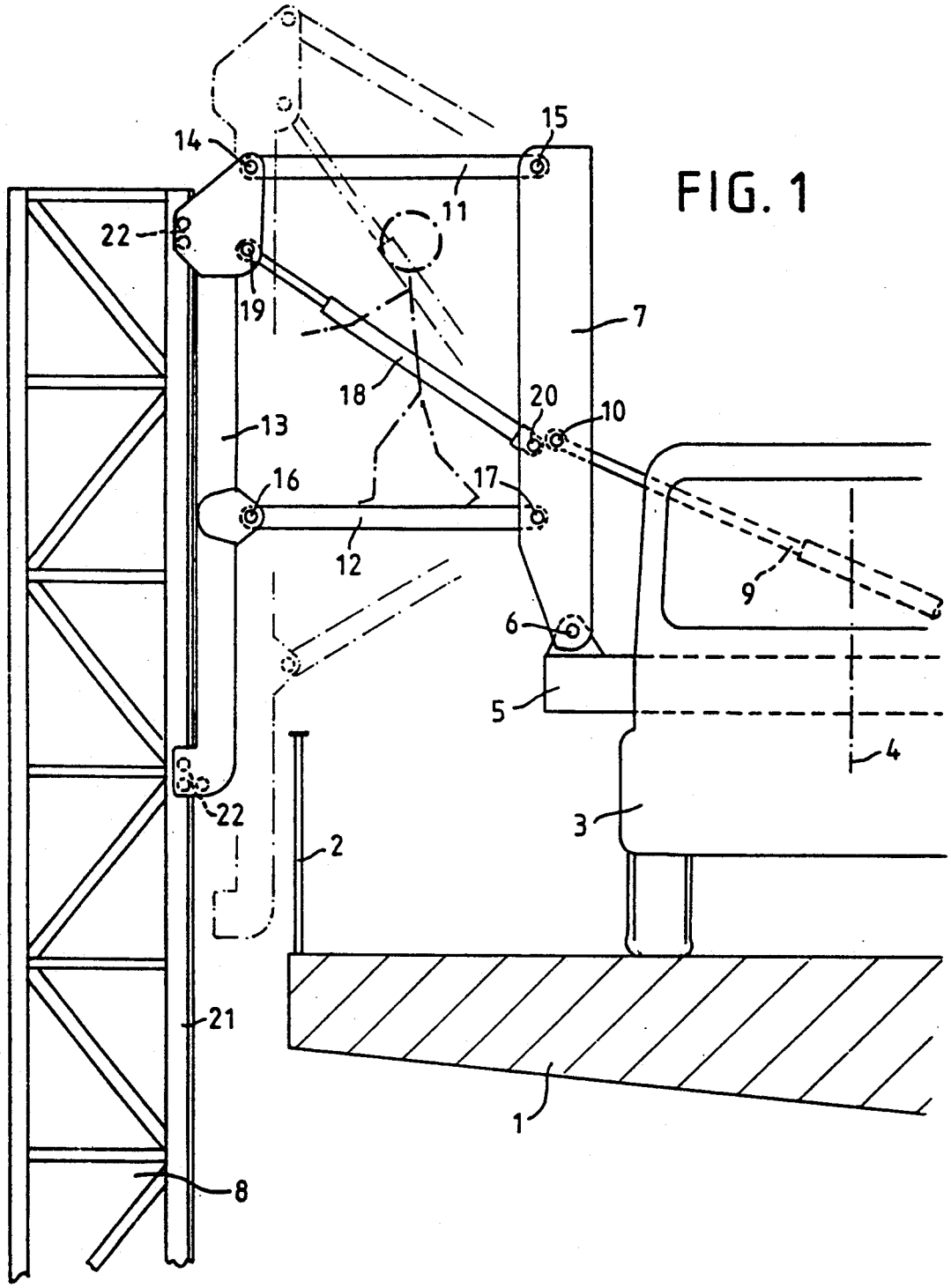
FIG. 1 shows a view of the top part of a bridge underview device in operating position, viewed in the longitudinal direction of the bridge.

The bridge 1 has, in the example, a railing 2. The function of the chassis is performed by a lorry 3, exhibiting a swiveling bolster 5, which is rotatable about a vertical axis 4. A bearing element 7 having a horizontal axis 6 is pivotably mounted on this bolster, which bearing element is configured as a rectangular frame through which the operating staff can climb into the elevating tower 8. By means of a lifting cylinder 9, which is attached at 10 to the bearing element 7, the bearing element 7 is pivoted from its horizontal transport position, in which it rests on the swiveling bolster 5, into the vertical working position shown.

Arms 11, 12 are attached to the bearing element 7, these being configured as double arms or frames (not visible in the side view). The arms 11, 12 are attached by their left ends to a guide member 13. The, in each case, horizontal articulated axes of the upper arm 11 are denoted by 14 and 15 and those of the lower arm 12 by 16 and 17. Two lifting cylinders 18 serve to actuate the arms or the double parallelogram formed by them, these lifting cylinders being attached at 19 and 20, i.e. high up on the guide member 13 and just below the centre of the bearing element. The guide tower 8, to the lower rotatable part of which a non-illustrated work platform is fitted, is only shown displaying its upper part. Its two corner uprights 21 adjoining the bridge 1 are reinforced and configured as guide rails, in which the rollers 22 or corresponding sliding elements of the guide member 33 are able to move along. The lifting cylinder, which moves the elevating tower in relation to the guide member, is not shown.

Figure 2:
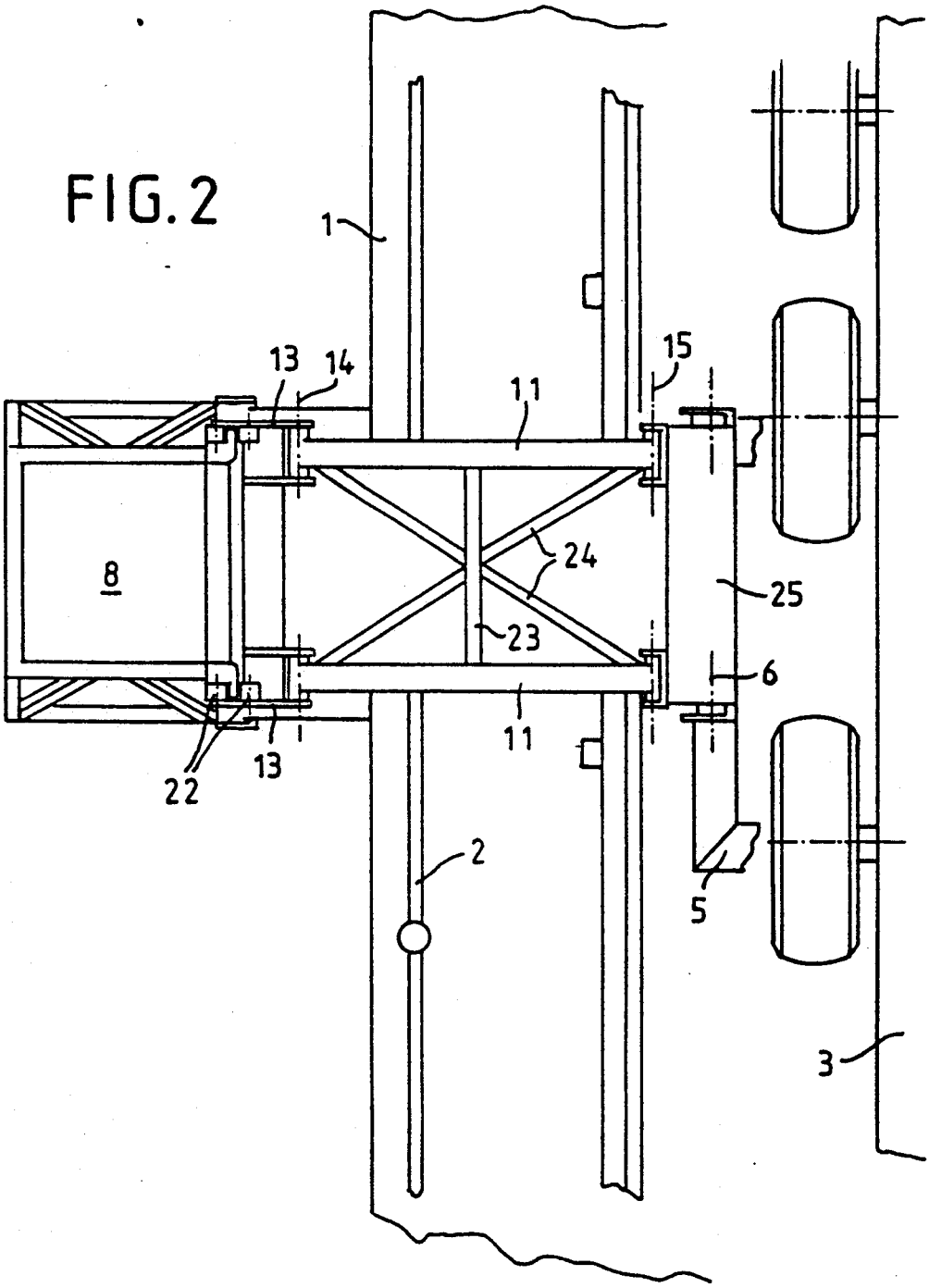
FIG. 2 shows a top view of the device according to FIG. 1.

From the top view according to FIG. 2, the counterbracing of the two upper arms 11 can be particularly clearly seen, namely a cross-tie 23 and two ties 24 in V-shape arrangement each. The vertical uprights of the bearing element 7 are connected to one another at the top by a crosshead 25. The guide member too, has a two-legged configuration and is transversely braced. The swiveling bolster 5 is shown only in fragmentary representation in the top view.

If the lifting cylinder 18 is extended, the arms 11 and 12 pivot upwards and correspondingly downwards when the lifting cylinder 18 is completed retracted. These end positions are in each case indicated by dot-dash lines. A central position of the arms 11, 12 between the two end positions is shown in solid lines. In such a central position the guide member 13 is at a maximum distance from the bearing element 7. Upon this pivotal movement, it is not only the height of the guide member 13 and of the thereby supported elevating tower which changes advantageously, but also its distance from the bridge. A transverse inclination of the bridge surface can be offset by readjusting the lifting cylinder 9, i.e. in this case, also, the elevating tower stands vertically.

Starting from the shown operating position, the dismantling of the device into the transport position is carried out as follows: firstly, the work platform (not shown) is pivoted outwards and then folded up against the elevating tower. The elevating tower 8 then travels to about halfway up, i.e. approximately into its position of equilibrium in relation to the arms 11 and 12. The bearing element 7, by the retraction of the lifting cylinder 9, now folds down onto the vehicle; the arms 11 and 12 stand in their mid-position at right angles to the bearing element 7 and to the elevating tower 8. As a result of the pivotal movement of the bearing element 7, the tower rises and pivots by its bottom end away f rom the bridge and by its upper end over onto the bridge. During the pivoting movement, the swiveling bolster 5 already begins to rotate, the upper elevating tower end still having a height of around four meters above the carriageway, so that, on the driving lane running next to the lorry 3, vehicles are able to drive through underneath it. Once the parallel position to the vehicle has been reached, the arms 11 and 12 are slightly pivoted and the guide member 13 thereby lowered somewhat. The elevating tower 8 now rests upon fixed mountings on the roof of the driver's cab and on the tail side of the vehicle.

It should be regarded as a particular advantage of the described device that the lifting movement which can be achieved by tilting the arms 11 and 12 can only be achieved by driving the lifting cylinder 18 in an exactly vertical direction. The climb to the elevating tower 8 is unproblematical. The arm 12 acts in this regard as a bridge or ramp, which can be traversed without hesitation, even in an inclined position, provided a suitably grip-fast grille is used. In the case of yet greater inclinations, a stairway having swivel steps can also be used.

As a result of the shortening and reduction in size of the bearing element 7 in comparison with the known elevating tower, substantial space savings are achieved in the transport position in front of and behind the bearing element and the arms 11 and 12 on the loading plane of the vehicle. In particular, cabins can be installed at these locations, which could serve as lodgings, for the duration of the works, for staff working on the bridge.

We claim:

1. A bridge underview device comprising (a) a chassis;

(b) a turntable mounted on said chassis and being rotatable about a vertical axis;

(c) a bearing element mounted on said turntable by a first pivot joint for a swinging motion about a horizontal axis of said first pivot joint;

(d) a guide member;

(e) an elevating tower;

(f) mounting means for mounting said elevating tower on said guide member for gliding displacement relative to said guide member;

(g) a first arm coupled to said bearing element by a second pivot joint and to said guide member by a third pivot joint;

(h) a second arm extending parallel to said first arm and being coupled to said bearing element by a fourth pivot joint and to said guide member by a fifth pivot joint; said second, third, fourth and fifth pivot joints each having a horizontal axis; said first and second arms being swingable in unison to either side beyond a central position of said first and second arms for swinging said guide member and said elevating tower as a unit relative to said bearing member in a vertical plane while maintaining an unchanged orientation; in said central position said guide member being at a maximum distance from said bearing element;

(i) first positioning means for maintaining said bearing member in a desired angular position relative to said chassis; and (j) second positioning means for maintaining said guide member in a desired distance relative to said bearing member.

2. The bridge underview device as defined in claim 1, wherein said first and second arms, a length portion of said bearing element between said first and second arms and a length portion of said guide member between said first and second arms constitute a parallelogram having sides articulated to one another.

3. The bridge underview device as defined in claim 1, wherein said second positioning means comprises power means for displacing said guide member and said elevating tower as a unit relative to said bearing element.

4. The bridge underview device as defined in claim 3, wherein said power means comprises a lifting cylinder assembly having a first end articulated to said bearing element and a second end articulated to said guide member.

5. The bridge underview device as defined in claim 1, wherein said first and second arms are length-adjustable.

* * * * *